US010598466B2

(12) United States Patent
Zehnter

(10) Patent No.: US 10,598,466 B2
(45) Date of Patent: Mar. 24, 2020

(54) BULLET PROJECTILE RESISTANT DRYWALL STRUCTURE

(71) Applicant: Knauf Gips KG, Iphofen (DE)

(72) Inventor: Heike Zehnter, Sonderhofen (DE)

(73) Assignee: Knauf Gips KG, Iphofen (DE)

( * ) Notice: Subject to any disclaimer, the term of this patent is extended or adjusted under 35 U.S.C. 154(b) by 0 days.

(21) Appl. No.: 15/783,759

(22) Filed: Oct. 13, 2017

(65) Prior Publication Data

US 2019/0113311 A1 Apr. 18, 2019

Related U.S. Application Data

(63) Continuation of application No. PCT/EP2015/000799, filed on Apr. 16, 2015.

(51) Int. Cl.

| | |
|---|---|
| ***F41H 5/24*** | (2006.01) |
| ***E04H 9/04*** | (2006.01) |
| ***E04B 1/92*** | (2006.01) |
| ***F41H 5/04*** | (2006.01) |
| ***E04F 13/12*** | (2006.01) |

(52) U.S. Cl.

CPC ..... *F41H 5/24* (2013.01); *E04B 1/92* (2013.01); *E04F 13/12* (2013.01); *E04H 9/04* (2013.01); *F41H 5/0464* (2013.01)

(58) Field of Classification Search

CPC . F41H 5/24; F41H 5/0464; E04H 9/04; E04H 9/06; E04B 1/92; E05G 1/024; E04F 13/12

See application file for complete search history.

(56) References Cited

U.S. PATENT DOCUMENTS

| | | | | |
|---|---|---|---|---|
| 2,884,779 A * | 5/1959 | Buergin | ..... | E04C 2/043 52/241 |
| 4,822,657 A * | 4/1989 | Simpson | ..... | B32L 37/02 428/69 |
| 5,279,091 A | 1/1994 | Williams | | |

(Continued)

FOREIGN PATENT DOCUMENTS

| | | | | |
|---|---|---|---|---|
| CA | 2927647 A1 * | 4/2015 | ..... | E04B 1/24 |
| DE | 29622165 U1 | 2/1997 | | |

(Continued)

OTHER PUBLICATIONS

What are Gypsum Panels?, Wisegeek.com, retrieved Jul. 6, 2018, p. 1.*

*Primary Examiner* — Jessie T Fonseca
(74) *Attorney, Agent, or Firm* — Mark Terry

(57) ABSTRACT

A bullet projectile resistant drywall structure for building a rifle bullet resistant separation wall, the drywall structure comprising a plurality of drywall profiles arranged in a manner so as to form a drywall sub structure capable of attaching building boards thereto, each drywall profile having a base portion and connected thereto parallel extending flange portions with an outer site capable of fixing building boards thereto by screws; a plurality of inner gypsum fiber boards arranged between the drywall profiles so as to extend between adjacent base portions of the drywall profiles and a plurality of outer gypsum fiber boards respectively attached to both outer sides of the parallel extending flange portions.

9 Claims, 3 Drawing Sheets

(56) References Cited

U.S. PATENT DOCUMENTS

| | | | | |
|---|---|---|---|---|
| 5,768,841 | A * | 6/1998 | Swartz | E04B 2/7457 52/281 |
| 2004/0103610 | A1* | 6/2004 | Axsom | E04B 1/80 52/481.1 |
| 2007/0245933 | A1 | 10/2007 | Kramer et al. | |
| 2008/0057318 | A1* | 3/2008 | Adzima | B32B 13/14 428/426 |
| 2010/0199892 | A1* | 8/2010 | Elliott | E04B 2/7457 109/83 |
| 2010/0297388 | A1* | 11/2010 | Dagher | F41H 5/013 428/116 |
| 2011/0233869 | A1* | 9/2011 | John | F41H 5/013 273/410 |

FOREIGN PATENT DOCUMENTS

| | | | | |
|---|---|---|---|---|
| EP | 2703575 | A1 * | 3/2014 | E04B 2/7457 |
| FR | 2757890 | A1 | 7/1998 | |
| GB | 1052073 | A * | 12/1966 | |
| GB | 1052073 | A1 | 12/1966 | |

* cited by examiner

BULLET PROJECTILE RESISTANT DRYWALL STRUCTURE

CROSS-REFERENCE TO RELATED APPLICATIONS

This patent application claims priority to, and is a continuation of, international application number PCT/EP2015/000799 filed Apr. 16, 2015 titled "BULLET PROJECTILE RESISTANT DRYWALL STRUCTURE". The subject matter of international application number PCT/EP2015/000799 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

BACKGROUND

Bullet projectile resistant structures are made with many materials. A brick wall of a thickness of 24 cm, for example, is projectile resistant. However, the brick wall has many disadvantages compared to a drywall construction. Herein, the term drywall structure or dry wall construction denotes any structure or building construction with a frame substructure with building panels or boards mounted thereto. The static advantage of a drywall compared to a brick wall is due to its reduced weight. Most walls in a building do have to withstand any forces from above so they can be built as drywall construction of comparably low weight Handgun bullet projectile resistant drywall structures are known in the state of the art. A conventional handgun bullet projectile resistant partition wall structure comprises a substructure of drywall profiles (metal profiles) which form upright studs. The upright studs are fixed to drywall profiles which are mounted horizontally, extending from the bottom to the raw ceiling. Typically, the distance between adjacent upright studs is about 65 cm. The upright studs comprise parallel extending flange portions having an outer surface capable of attaching boards (building panels) thereto. Both parallel extending flanges are connected via a base portion. The parallel extending flanges and the base portion can be arranged in a C-form or a U-form.

To achieve the handgun bullet projectile resistance for a separation wall, it is known to arrange inside the substructure, i.e. only in the space formed between the base portions of adjacent drywall profiles, gypsum fiber boards. Inside the substructure (separation wall) means that the gypsum fiber boards are arranged so as to extend between the drywall profiles, only. The gypsum fiber boards stand between the base portions. It is uncommon to fix gypsum fiber boards to the flange portions of a substructure because of their high weight compared to a gypsum plasterboard. For example, the gypsum fiber board with the product name Knauf "Torro" has an areal density of 42 kg/m$^2$. Moreover, the gypsum fiber boards cannot be mounted like gypsum plasterboards since conventional screwing is not possible without pre-drilling.

Known structures provide projectile resistance performance of class FB4 (BR4 English language equivalent) according to ballistic standard DIN EN 1522 which is the highest class of protection against hand guns. EN 1522 is the Euro-norm standard for bullet resistance by which structures are tested and rated. Class FB4 (BR4) resists 3 shots of a handgun 0.44 Magnum FJ (Full Metal Jacket)/FN (Flat Nose)/SC (Soft Core) of the weight 15.6±0.1 g from a range of 5.00±0.5 m having a velocity of 440±10 m/s and an impact energy of 1510 J.

Tests have shown that conventional separation wall structures of the above described type are not suitable for bullet projectile resistance of higher classes. In fact, test shots with a rifle, in particular the sizes of the formed shot channels, on those handgun bullet projectile resistant drywall structures lead to the impression that no drywall construction would stand a rifle bullet projectile. The next class higher than FB4 is FB 5 (BR5) which is the first class for the resistance against rifle bullets. FB5 structures resist three shots from a rifle in caliber 5.56×45 mm NATO FJ (Full Metal Jacket)/PB (Pointed Bullet)/SCP (Soft Core (lead) & Steel Penetrator) of the weight 4.0±0.1 g from a range 10.00±0.5 m having a velocity of 950±10 m/s with an impact energy of 1800 J.

There is a strong need for drywall constructions with increased bullet resistance compared to the state of the art. Killing sprees and terrorizing assaults are mostly carried out by use of rifles. Hence the handgun bullet projectile resistance is not sufficient and structures with rifle bullet projectile resistance are required. One specific field of application are structures in public buildings (schools, police stations, court buildings, etc.). Further fields of application are easily conceivable.

SUMMARY

This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

The claimed subject matter relates to a bullet projectile resistant drywall structure for building a rifle bullet resistant separation wall, the drywall structure comprising a plurality of drywall profiles arranged in a manner so as to form a drywall sub structure capable of attaching building boards thereto, each drywall profile having a base portion and connected thereto parallel extending flange portions with an outer site capable of fixing building boards thereto by screws; a plurality of inner gypsum fiber boards arranged between the drywall profiles so as to extend between adjacent base portions of the drywall profiles and a plurality of outer gypsum fiber boards respectively attached to both outer sides of the parallel extending flange portions.

BRIEF DESCRIPTION OF THE DRAWINGS

In the following the invention will be explained in more detail with reference to drawings. Like reference numerals denote similar features throughout the drawings.

DETAILED DESCRIPTION

Figure 1:
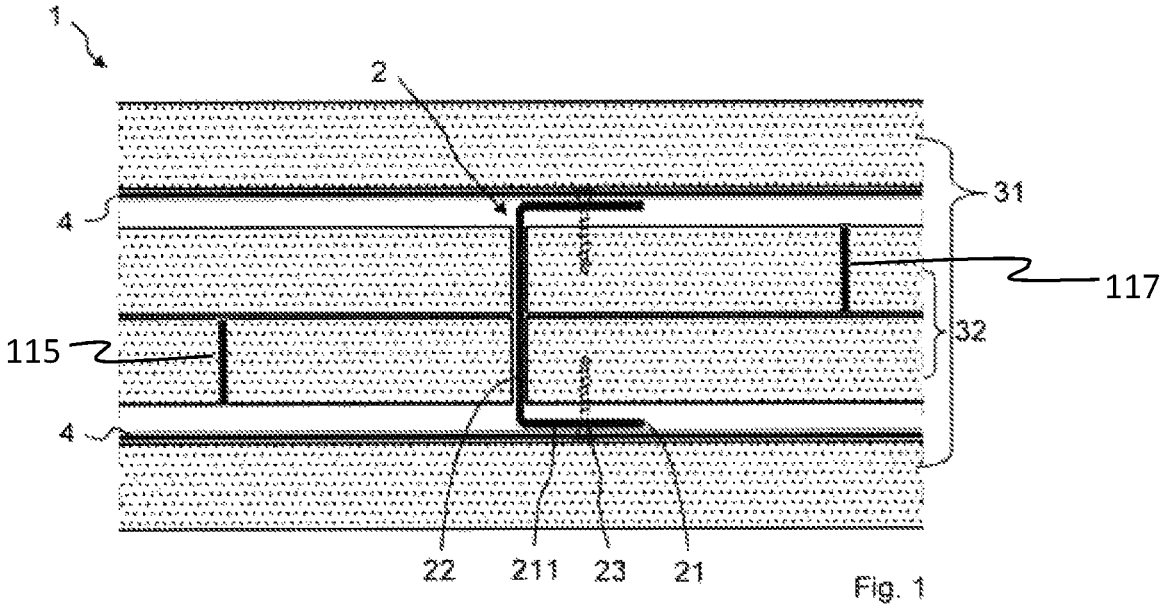
FIG. 1 is a vertical cross-section of the bullet projectile resistant drywall separation wall with a sheet metal layer.

The invention relates to a bullet projectile resistant drywall. The bullet projectile resistant drywall structure can be used for building a bullet resistant separation wall or for the construction of a bullet resistant ceiling.

The object of the invention is therefore to provide a bullet projectile resistant drywall structure, which has a bullet resistance performance for rifle bullets and shows the advantages of drywall constructions. The bullet projectile resistant drywall structure is to be used particularly in public buildings which are accessed by many people.

The problem is solved by a bullet projectile resistant drywall structure with the features of claim 1. Preferred aspects form the subject matter of the dependent claims.

According to the invention a bullet projectile resistant drywall structure for building a separation wall comprises a plurality of drywall profiles arranged in a manner so as to form a drywall substructure capable of attaching building boards thereto. Each drywall profile has a base portion and parallel extending flange portions having an outer site capable of attaching building boards thereto. A plurality of inner gypsum fiber boards is arranged between the drywall profiles so as to extend between the base portions of adjacent drywall profiles and a plurality of outer gypsum fiber boards is directly or indirectly attached to the respective outer side of both parallel extending flange portions. Directly or indirectly attached to the outer side of the flange portion means that the boards can be fixed to the flange portion face to face or through another layer that is arranged between the flange portion and the board. This layer can for example be a metal sheet layer.

By providing not only the inner gypsum fiber boards but additional outer gypsum fiber boards to increase the overall number of gypsum fiber board layers (i.e., the overall thickness of gypsums fiber boards), the bullet resistance of the structure is increased compared to known structures having only inner gypsum fiber boards arranged inside the substructure. Surprisingly the improved structure has shown to be capable of resisting three shots from a rifle in caliber 5.56×45 mm NATO FJ (Full Metal Jacket)/PB (Pointed Bullet)/SCP (Soft Core (lead) & Steel Penetrator) of the weight 4.0±0.1 g from a range 10.00±0.5 m having a velocity of 950±10 m/s with an impact energy of 1800 J so as to comply with FB5. To have gypsum fiber boards attached to the outer sides of the drywall profiles has the advantage over the prior art structures that additional layers of gypsums fiber boards are attached on a known substructure. A structure according to such a construction principle is not yet known because of the conventional drywall profiles have been deemed not to be of a sufficient strength.

A preferred aspect relates to that the plurality of inner gypsum fiber boards are arranged in two individual layers extending parallel in a longitudinal direction of the drywall structure. The gypsum fiber boards of a first of the two parallel layers are arranged staggered with respect the gypsum fiber boards of a second of the two parallel layers so that there are no common abutting edge joint (joint formed by the edges of abutting gypsum fiber boards) completely extending through in a cross-direction of the drywall structure. The abutting edge joint is formed by abutting adjacent gypsum fiber boards. The cross direction is the direction in the thickness of the structure and hence, the main direction of the impacting bullet. In this construction the joints formed by the abutting gypsum fiber boards are arranged in an offset pattern so that no common abutting edge joints extend across the drywall structure. This is achieved by a displaced arrangement of the parallel extending boards (boards).

Advantageously, the gypsum fiber boards of a first of the two parallel layers are arranged staggered with respect the gypsum fiber boards of a second of the two parallel layers so that the adjacent abutting edge joints 115, 117 of the parallel layers have a respective distance of half of the length of the gypsum fiber boards. See, for example, the distance between edge joints 115 and 117. This allows arranging the inner gypsum fiber boards comparable to a brick wall while a maximum bullet resistance is achieved.

For an improved strength, the bullet projectile resistant drywall structure further comprises a sheet metal layer arranged between the plurality of outer gypsum fiber boards and the respective outer sides of the parallel extending flange portions. The sheet metal layer is screwed to the drywall profiles and the outer gypsum fiber boards can be attached to the sheet metal layer by an adhesive. Hence the screwing and in particular the pre-drilling of the gypsum fiber boards is not needed.

In one additional aspect, a gypsum plasterboard layer is arranged between the sheet metal layer and the respective outer sides of the parallel extending flange portions. This allows to further increase the bullet projectile resistance of the structure. In specific examples further layers of gypsum plasterboards as well as sheet metals can be used. The sheet metal layer has a thickness preferably above 0.5 mm.

Alternatively, the bullet projectile resistant drywall structure can be formed without a sheet metal layer, wherein a gypsum plasterboard layer is arranged between the plurality of outer gypsum fiber boards and the respective outer sides of the parallel extending flange portions.

The tests have been made with gypsum fiber boards of a density above 1200 kg/m$^3$. Best results have been achieved with gypsum fiber boards of a density above 1500 kg/m$^3$ and a thickness of more than 28 mm. The product "Knauf Torro" is a gypsum fiber board of a density of 1500 kg/m$^3$ provided in a thickness of 28 mm. The tested structure consists of two parallel extending layers of inner gypsum fiber boards and one layer of gypsum fiber boards on each of the outer sides of the parallel extending flange portions.

In the following the bullet projectile resistant drywall structure according to the invention will be explained in more detail with reference to drawings. Like reference numerals denote similar features throughout the drawings. Aspects shown in the drawings can be connected and combined with each other in any technically possible way.

FIG. 1 is a vertical cross-section of the bullet projectile resistant drywall separation wall 1 which shows the advantages of the invention and complies with projectile resistance performance of FB5. The structure comprises two individual, sheet metal layers 4 to provide a good strength and good workability.

The bullet projectile resistant drywall structure 1 comprises drywall profiles 2 (only one is shown) having a base portion 22 and connected thereto parallel extending flange portions 21. The flange portions have outer sites 211 capable of fixing gypsum fiber boards thereto. The depicted drywall profile 2 is a metal profile which represents a plurality of drywall profiles 2 arranged in a manner so as to form a substructure.

A plurality of inner gypsum fiber boards 32 are arranged parallel between the drywall profiles 2 so as to extend between the base portions 22 of adjacent drywall profiles 2. In this representation only one drywall profile 2 is shown, however the arrangement between the base portions 22 can easily perceived. A plurality of outer gypsum fiber boards 31 are respectively attached to the outer sides 21 1 of both parallel extending flange portions 21. This structure provides four layers of gypsum fiber boards 31, 32 which are to be penetrated by a bullet travelling in the direction of the thickness of the separation wall. The gypsum fiber boards 31, 32 have a thickness of 28 mm and a density of 1500 kg/m$^3$. For better processing the sheet metal layer 4 (thickness 1 mm) is arranged between the plurality of outer gypsum fiber boards 31 and the respective outer sides 211 of the parallel extending flange portions 21.

According to the invention by providing inner gypsum fiber boards 31 and outer gypsum fiber boards 32, the strength of the structure 1 is increased compared to known structures having only inner gypsum fiber boards arranged inside the substructure. The shown separation wall structure 1 is capable of resisting three shots from a rifle in caliber 5.56×45 mm NATO FJ (Full Metal Jacket)/PB (Pointed Bullet)/SCP (Soft Core (lead) & Steel Penetrator) of the weight 4.0±0.1 g from a range 10.00±0.5 m having a velocity of 950±10 m/s with an impact energy of 1800 J so as to comply with FB5.

Figure 2:
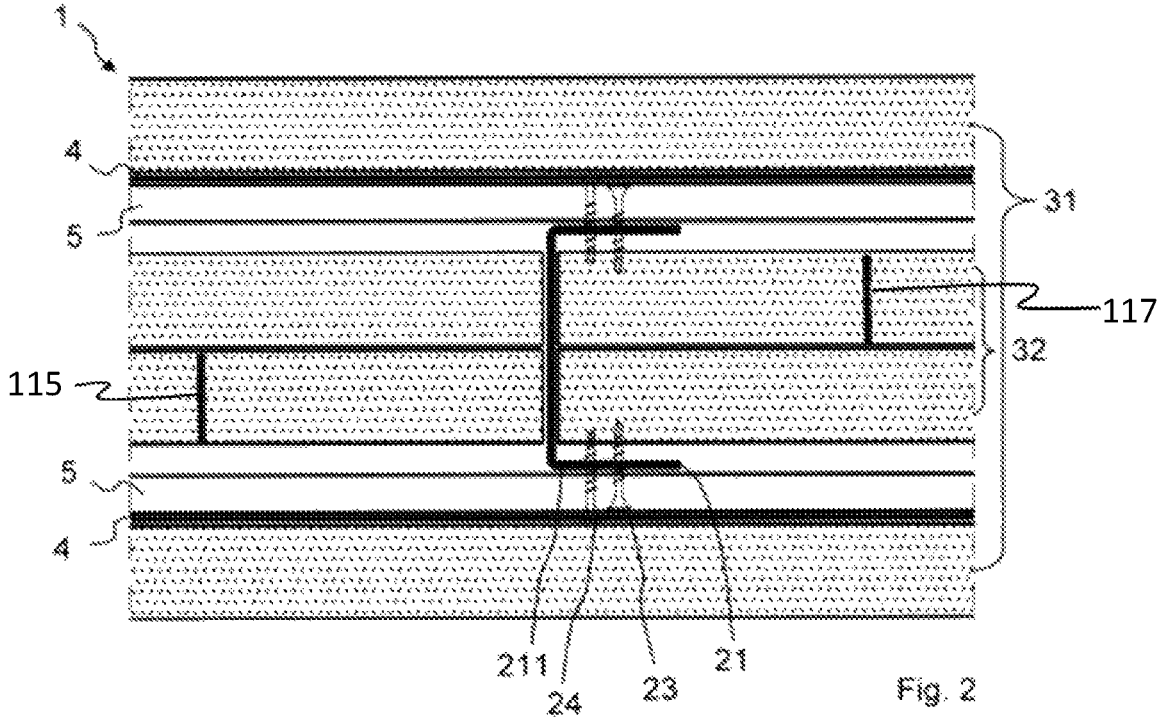
FIG. 2 is a vertical cross-section of the bullet projectile resistant drywall separation wall with a sheet metal layer and a plasterboard layer.

Another example for a structure according to the invention is shown in FIG. 2 which is a vertical cross-section of the bullet projectile resistant drywall separation wall 1 with a sheet metal layer 4 and a plasterboard layer 5. The gypsum plasterboard layer 5 is arranged between the sheet metal layer 4 and the respective outer sides 21 1 of the parallel extending flange portions 21. The shown sheet metal layer 4 is sheet metal of a thickness of 1 mm. The plasterboard layer 5 is separately screwed to the profile 2 with screws 23. The sheet metal layer 4 is screwed by separate screws 24 to the layer of plasterboards 5. Additionally an adhesive (not visible in this presentation) can be applied between the sheet metal layer 4 and the plasterboard 5. An advantage of this structure is that the outer gypsum fiber boards 31 can be fixed to the sheet metal layer 4 by an adhesive applied over the entire contact area and no screws and pre-drilling is needed. The arrangement order of the sheet metal layer 4 and the plasterboard layer 5 can, of course, also be reverse.

Figure 3:
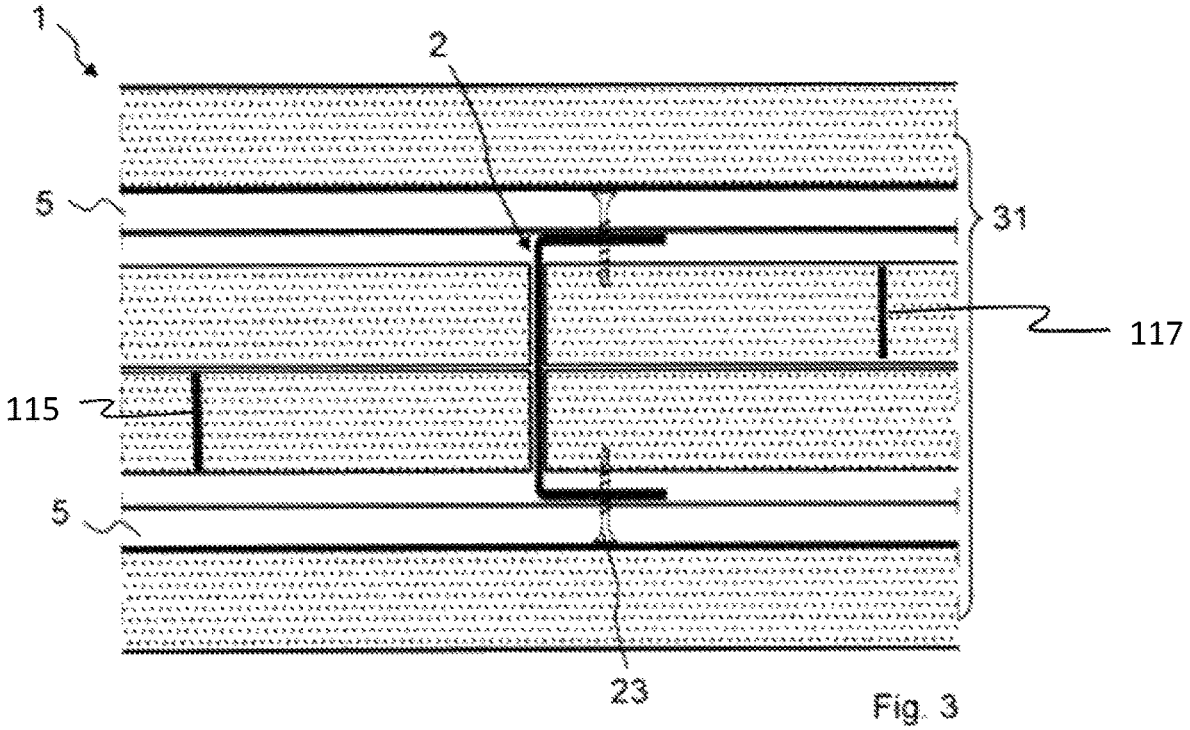
FIG. 3 is a vertical cross-section of the bullet projectile resistant drywall separation wall with only a plasterboard layer.

Another vertical cross-section of the bullet projectile resistant drywall separation 1 wall is shown in FIG. 3 with a plasterboard layer 5. The outer gypsum fiber boards 31 are fixed to a layer of plasterboards 5 by an adhesive. The plasterboards 5 are screwed to the drywall profile 2. This construction allows to avoid to fix the outer gypsum fiber boards 31 without screws and, thus, without pre-drilling.

Figure 4:
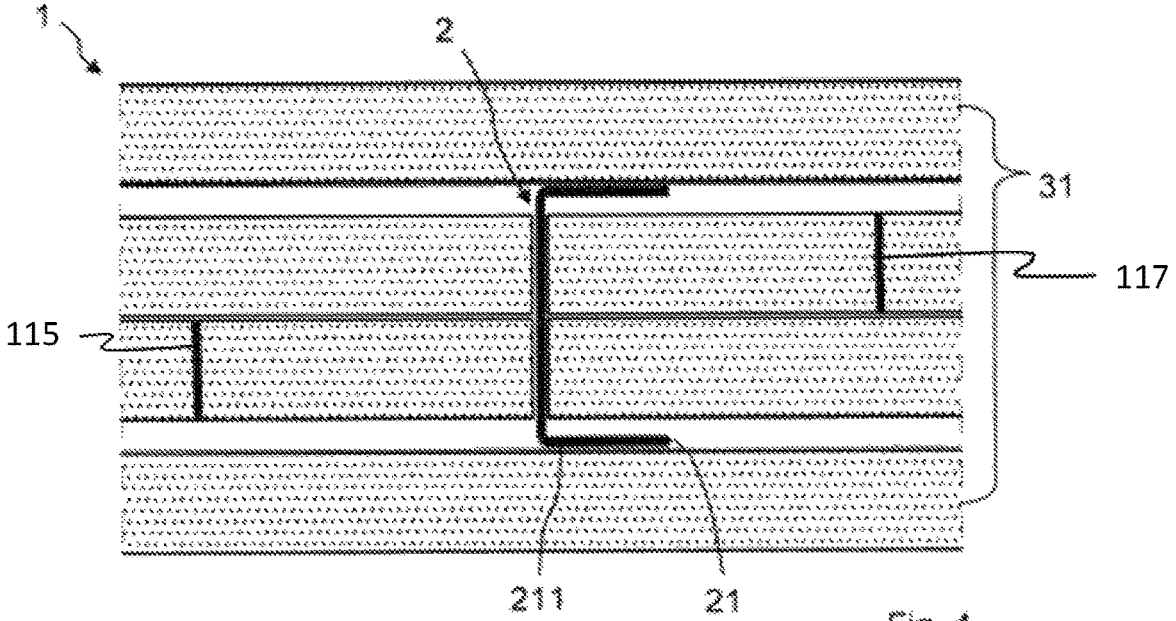
FIG. 4 is a vertical cross-section of the bullet projectile resistant drywall separation wall having the outer gypsum fiber boards attached to the drywall profiles by an adhesive.
Figure 5:
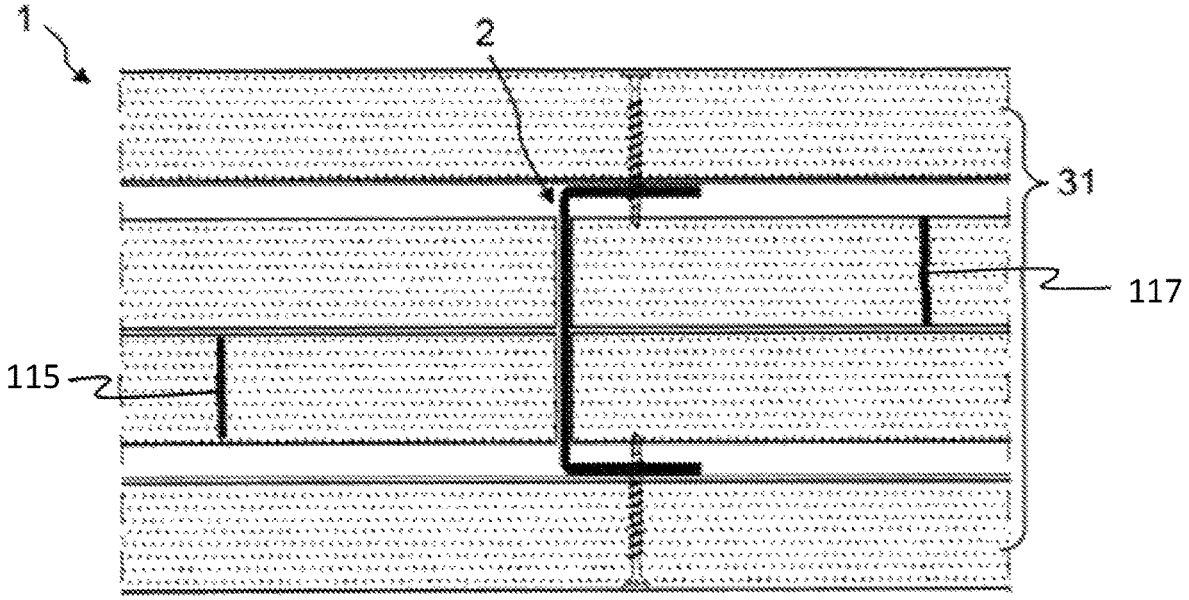
FIG. 5 is a vertical cross-section of the bullet projectile resistant drywall separation wall having the outer gypsum fiber boards attached to the drywall profiles by screws.

In FIG. 4 and FIG. 5 the bullet projectile resistant drywall separation wall 1 has been constructed so that the outer gypsum fiber boards 31 are directly attached to the outer surfaces 21 1 of the flange portions 21 of the drywall profile 2. In FIG. 4 this is carried out by use of an adhesive (not visible in this presentation since only a thin layer is applied) and in FIG. 5 this is carried out by use of drywall screws 24.

What is claimed is:

1. A bullet projectile resistant drywall structure, the drywall structure comprising a plurality of metal profiles arranged in a manner so as to form a drywall substructure, each metal profile having a base portion and connected thereto parallel extending flange portions capable of fixing building boards thereto;

a plurality of inner gypsum fiber boards arranged between the metal profiles so as to extend between the base portions of adjacent metal profiles;

a plurality of outer gypsum fiber boards directly or indirectly attached to the parallel extending flange portions;

a sheet metal layer arranged between the plurality of outer gypsum fiber boards and respective outer sides of the parallel extending flange portions;

wherein the plurality of inner gypsum fiber boards are arranged in two individual layers extending parallel in a longitudinal direction of the drywall structure, and wherein the gypsum fiber boards of a first of the two parallel layers are arranged staggered with respect the gypsum fiber boards of a second of the two parallel layers so that no common abutting edge joints extend across the drywall structure.

2. The bullet projectile resistant drywall structure according to claim 1, wherein adjacent edge joints of the two parallel layers have a respective distance between them.

3. The bullet projectile resistant drywall structure according to claim 1, further comprising a gypsum plasterboard layer arranged between the sheet metal layer and the respective outer sides of the parallel extending flange portions.

4. The bullet projectile resistant drywall structure according to claim 1, wherein the sheet metal layer comprises sheet metal of a thickness above 0.5 mm.

5. The bullet projectile resistant drywall structure according to claim 1, further comprising a gypsum plasterboard layer arranged between the plurality of outer gypsum fiber boards and respective outer sides of the parallel extending flange portions.

6. The bullet projectile resistant drywall structure according to claim 1, wherein the gypsum fiber boards are of a density above 1200 kg/m$^3$, or a density above 1500 kg/m$^3$.

7. The bullet projectile resistant drywall structure according to claim 1, wherein the gypsum fiber boards are of a thickness of more than 28 mm.

8. The bullet projectile resistant drywall structure according to claim 1, the gypsum fiber boards having a density of 1500 kg/m$^3$ and a thickness of 28 mm.

9. The bullet projectile resistant drywall structure according to claim 1, wherein the drywall structure resists rifle bullets according to the FB5 test of DIN EN 1522.

* * * * *